United States Patent [19]

Lacey

[11] 4,056,152

[45] Nov. 1, 1977

[54] DRILL BIT FOR REINFORCED CONCRETE

[76] Inventor: Patrick J. Lacey, 247 Hollywood Ave., Crestwood, N.Y. 10707

[21] Appl. No.: 732,268

[22] Filed: Oct. 14, 1976

[51] Int. Cl.[2] ..... E21B 9/36

[52] U.S. Cl. ..... 175/330; 175/403; 125/20; 408/204

[58] Field of Search ..... 175/403, 394, 404, 405, 175/402, 387, 330; 125/20; 408/204, 205, 206

[56] References Cited

U.S. PATENT DOCUMENTS

| | | | |
|---|---|---|---|
| 2,081,302 | 5/1937 | Jarvis | 175/330 |
| 2,188,631 | 1/1940 | Kraus | 175/403 X |
| 2,524,570 | 10/1950 | Phipps | 175/403 |
| 2,577,605 | 12/1951 | Clayton | 175/403 |
| 2,856,157 | 10/1958 | Chapin et al. | 175/403 X |
| 2,951,683 | 9/1960 | Tilden | 175/403 X |
| 2,969,122 | 1/1961 | Steffes | 175/403 |
| 3,592,554 | 7/1971 | Takahara | 408/204 |
| 3,609,056 | 9/1971 | Hougen | 408/204 |

*Primary Examiner*—Ernest R. Purser
*Assistant Examiner*—Richard E. Favreau
*Attorney, Agent, or Firm*—Dowell & Dowell

[57] ABSTRACT

A rotary bit for drilling concrete and reinforced concrete having a hollow drill stem with a transversely disposed drilling face at its outer end, the face having annularly disposed sawtooth surfaces including abrupt step portions alternating with trailing portions extending from the apex of a step to the root of the succeeding step, the trailing portions having diamond chips thereon and comprising crushing and grinding surfaces for the cuttings, and being sloped radially outwardly and axially upwardly to displace particles toward the outer periphery of the bit, and the bit having particle escape channels up its side surface adjacent the leading edges of the step portions which have hardened cutter inserts.

3 Claims, 4 Drawing Figures

DRILL BIT FOR REINFORCED CONCRETE

FIELD OF INVENTION

This invention relates to rotary drill bits of the type used for drilling concrete having reinforcement bars or other metallic reinforcements embedded therein, and more particularly relates to improvements in bits of this type to make them last longer in service.

BACKGROUND AND PRIOR ART

There have been many proposed structures for drills designed to drill concrete with metal reinforcement members embedded therein. The need for efficient drilling bits has been greatly increased by the construction techniques used in nuclear reactors and the like in which a very heavily reinforced concrete is used. Reinforcement bars are used to such an extent that prior art drills sometimes have to be changed many times before a hole can be completed therethrough.

The prior art shows a number of drills of the general type to which the present disclosure is related.

Typical drills having cutting faces using hardened cutting inserts are shown in U.S. Pat. Nos. 2,524,570 to Phipps; 2,856,157 to Chapin et al.; and 2,969,122 to Steffes. The latter patent shows hardened inserts raked away from the direction of travel of the bit, and this is also true of U.S. Pat. No. 2,856,157 set forth above.

U.S. Pat. No. 2,081,302 to Jarvis shows a combination bit having both hardened inserts and also chips set in its face, although all of these inserts appear to be on the same plane.

U.S. Pat. No. 2,511,991 to Nussbaum shows the combination of diamonds and carbide tips in the face of a cutting bit, and U.S. Pat. No. 3,066,749 to Hildebrandt is of a roughly similar type.

THE INVENTION

The present invention comprises a drill stem which is hollow and has a generally saw-tooth cutting face at its outer end, the cutting face having step portions where hardened carbide cutting inserts are secured, and also having trailing portions sloping from a point near the apex of each step to the root of the next succeeding step. The trailing portions of the saw-tooth face are sloped radially outwardly away from the center of the stem and axially upwardly away from the cutting end of the stem. The cutters are raked away from the direction of rotation of the bit, and an escape channel is recessed in the outer surface of the stem immediately in front of each insert, the channel extending a small distance up the outer surface of the stem beyond the upper end of the hardened insert. A number of diamond chips are secured to the trailing surface portions of the saw-tooth face, but they are recessed below the cutting edges of the inserts. There are a relatively small number of inserts in the present bits as compared with the showings of the prior art.

It is a principal object of this invention to provide an improved drill bit for drilling reinforced concrete, which bit is not readily destroyed by the drilling of successive reinforcement bars or other types of metal reinforcement.

It has been discovered that the type of drill to which the present invention relates is more efficient and lasts longer when cutting through metal reinforcements in concrete if there are fewer hardened cutter locations than have generally been provided in the past. The present invention advocates cutting bits spaced rather sparsely around the annular cutting face, preferably at spacings of 120° for small size bits up to 1 inch, and at spacings of about 90° for larger bits measuring several inches in diameter. It has been observed that bits having only a few hardened cutter inserts chatter to a much lesser extent than bits having a larger number of cutters, as shown in the prior art, when the bits are drilling through concrete in locations where they are encountering reinforcement members. The lesser number of hardened cutters appears to do a more efficient job of gouging pieces of metal out of the reinforcement members as they pass through them.

It is another important object of the invention to provide improved shaping of the trailing surface portions of the saw-tooth cutting surfaces, these surfaces being made relatively longer than those of the prior art as measured in the annular direction since there are fewer cutter inserts. In addition, the trailing portions of the saw-tooth cutting surfaces are sloped axially upwardly toward the inner end of the drill bit as they progress radially outwardly from the center of the bit. This provides a deflecting action which tends to throw the cut particles radially outwardly of the bit and into the clearance space between the stem of the bit and the periphery of the hole which it is drilling, there being a clearance space provided which is attributable to the fact that the cutter inserts extend outwardly beyond the outer periphery of the drill stem. The cutters also extend inwardly into the hollow center of the drill stem, thereby providing clearance inside of the stem as well, this type of clearance being well known in the prior art.

The outward and upward sloping of the trailing surfaces of the saw-tooth are believed to be novel in a drill bit of this type where particle grinding surfaces are located between successive cutter inserts and carry diamond chips.

Still a further object of the invention is to provide a drill bit of the type specified in which the trailing surfaces of the saw-tooth cutting face slope upwardly as they extend radially outwardly from the center of the bit, and wherein at the end of each trailing surface where it intersects the root of the next succeeding cutter there is provided an escape channel for the cuttings, the channel extending up the side of the drill stem in the general direction of its axis from a point adjacent the root of the cutter insert to a point somewhat higher on the stem than the height of the exposed outer edge of the cutting insert. This arrangement provides an escape path for small granular chips which require no further reduction in size. The larger cuttings and particles tend to roll into the space between the diamond covered trailing surfaces of the cutting face and the bottom of the hole being drilled whereupon they are ground into smaller particles which can eventually pass radially outwardly beyond the edge of the drill stem and into the clearing space between the stem and the periphery of the hole being drilled. The fact that the trailing surface slopes upwardly as it extends radially outwardly tends to throw the ground chips toward the periphery of the hole.

Other objects and advantages of the invention will become apparent during the following discussion of the drawings, wherein:

THE DRAWINGS

Figure 1:
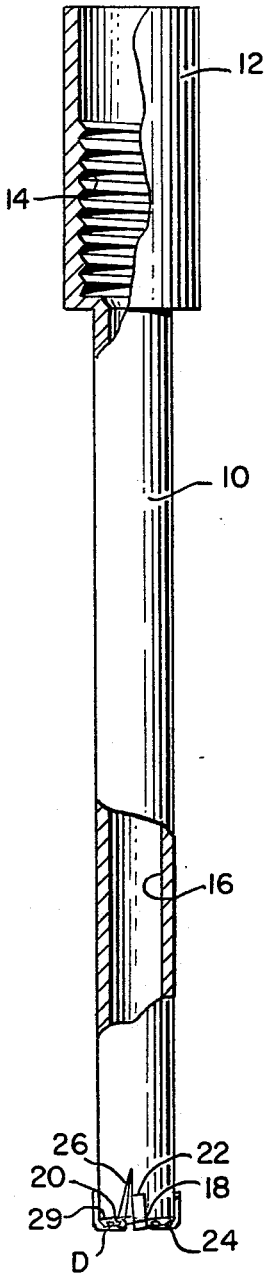
FIG. 1 is a side view, partly in cross-section showing a drill according to the present invention.
Figure 2:
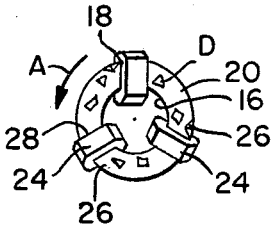
FIG. 2 is an end view of the cutting face of the drill shown in FIG. 1, but drawn to an enlarged scale.

Referring now to FIGS. 1 and 2, the illustrative embodiment shown in these figures comprises a drill stem 10 having a coupling 12 at its inner end provided with internal threads 14 for connection to a rotary machine (not shown). The drill stem 10 has a hollow bore 16 extending up through its center, and the outer end of the drill stem is provided with a cutting face which is saw-tooth in shape and has a series of abrupt step portions 18 separated by trailing surface portions 20.

At each of the step portions there is a slot 22 which extends approximately axially up into the drill stem 10 and is intended to receive a hardened cutter insert 24 which is secured in the slot 22 in a manner well known per se, for instance by braising. The cutter is raked away from the direction of travel of the bit as shown by the arrow A, this rake making it more able to gouge metal out of a reinforcing bar encountered by the bit.

Figure 3:
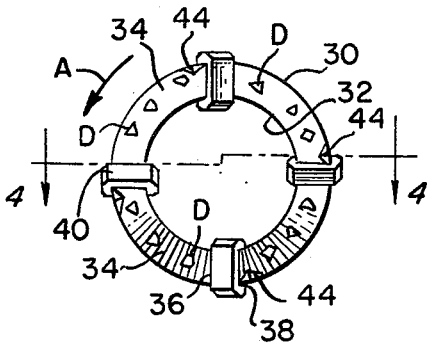
FIG. 3 is an end view of a drill bit of larger diameter having cutter inserts spaced at intervals of 90° instead of a 120°.
Figure 4:
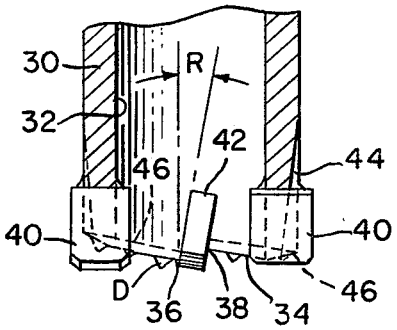
FIG. 4 is a partial cross-sectional view taken along line 4—4 of FIG. 3.

FIGS. 3 and 4 relate to a somewhat different embodiment of the invention suitable for larger diameter bits and showing the cutter members 40 spaced at intervals of 90° instead of at 120° as shown in FIGS. 1 and 2.

In FIGS. 3 and 4, the stem 30 is also hollow as at 32. The saw-tooth cutting face can be seen much more clearly in FIG. 4 which illustrates the manner in which each of the trailing surfaces 34 extends from a point near an apex 36 of the step portion to the root 38 of the adjacent step portion. In FIGS. 3 and 4 the hardened cutter inserts are labelled 40, and each of them is mounted in a slot 42 in the side wall of the stem 10. These cutters are also raked at an angle R in a manner which is well known in the prior art.

In the figures of the drawing, the trailing cutter face surfaces represented by the reference numerals 20 and 34 are provided with diamond chips D which are bonded to the surfaces in one of several well known manners, and these chips are generally recessed in the axial direction of the stem somewhat behind the actual cutting edges of the hardened inserts 24 and 40.

It will be noted that the side walls of the stems 10 and 30 are provided with escape channels which are labelled 26 in FIGS. 1 and 2, and 44 in FIGS. 3 and 4. These escape channels provide a route through which small particles can escape immediately from the leading face of the cutter inserts, these channels extending along the stem in the axial direction thereof from a location immediately in front of each cutter insert to a location higher along the stem by a distance such that they extend above the slots 22 in which the cutters are seated in FIGS. 1 and 2, or the slots 42 as shown in FIG. 4 in which the cutters 40 are seated.

As can best be seen in FIGS. 1 and 4, the trailing portions of the saw-tooth surface extend at a substantially constant angle away from the apex of the step portion 18 in FIGS. 1 and 2, and 36 in FIGS. 3 and 4, to the root of the succeeding cutter member which is labelled 28 in FIG. 2 and 38 in FIGS. 3 and 4. It is also very important to note that these trailing surfaces 20 and 34 slope upwardly and outwardly as can be seen most clearly at 46 in FIG. 4 and 29 in FIG. 1. This upward and outward slope of the trailing surfaces 20 and 34 has a tendency to displace the cutting particles outwardly into the outer periphery of the drilled hole, rather than to have the particles accumulate in the clearance space inside the inner surface of the bore 16 or 32 of the drill stem, the clearance inside the drill stem being considerably smaller than the clearance outside of the drill stem from the point of view of the total volume of particles which it can accomodate. The angle of the slope of the trailing surfaces 20 and 34 is not particularly critical, but should be selected bearing in mind the fact that if the angle of the slope is too great it will destroy the usefulness of the trailing surfaces for grinding up the particles into smaller particles, whereas, if it is too small it will not displace more particles outwardly of the grinding area into the outer periphery than into the inner periphery.

The present invention is not to be limited to the exact forms shown in the drawings for obviously changes can be made within the scope of the art.

For instance, drills of this type are often made in much larger diameters than the one or two inch sizes mentioned in connection with the illustration of FIGS. 3 and 4. These bits are manufactured in sizes up to 14 inches in diameter at the cutting end of the bit, and such bits will of course have more than four carbide inserts because of their large diameter.

The invention is summarized in the accompanying claims:

I claim:

1. A bit to be driven by a rotary machine for drilling concrete containing metal reinforcements, said bit comprising:

a. a body having a coupling at its inner end for connection to said machine and having a hollow-stem extending outwardly from said coupling and terminating in an annular cutting face at its outer end;

b. The cutting face comprising a saw-tooth shape having multiple abrupt leading step portions facing in the direction of rotation of the bit, and having multiple trailing portions sloping circumferentially at a substantially constant angle away from the apex of each step portion to the root of the next succeeding step portion;

c. a hardened cutter insert secured against the leading edge of each step portion and having a cutting edge extending outwardly of the drill beyond the apex of the step, and having an inner end recessed in a slot in the hollow stem adjacent to the root of the step, each cutter insert being raked away from the direction of rotation of the bit;

d. the trailing portions of the annular saw-tooth face having surfaces sloping radially outwardly away from the center of the stem and axially away from its outer end so that cuttings are displaced away from the center of the bit toward the periphery of the hole being drilled;

e. the surfaces of said trailing portions of the saw-tooth face having diamond chips bonded thereto, the chips being recessed below the cutting edges of the hardened inserts; and f. the outer surface of the stem being longitudinally recessed to provide an escape channel for cuttings which extends axially along the stem from a location immediately in front of each insert toward the inner end of the stem and past the slot which supports the adjacent insert.

2. The bit as set forth in claim 1, wherein the step portions and the cutter inserts are annularly spaced around the cutting face at intervals of 120°.

3. The bit as set forth in claim 1, wherein the step portions and the cutter inserts are annularly spaced around the cutting face at intervals of 90°.

* * * * *